US011564511B2

(12) United States Patent
Vallatini et al.

(10) Patent No.: US 11,564,511 B2
(45) Date of Patent: Jan. 31, 2023

(54) COLLAGE FRAME WITH VARIABLE MOUNT AND CONFIGURATION

(71) Applicants: Joseph Leo Vallatini, Plymouth, MA (US); Eleanore Vallatini, Plymouth, MA (US)

(72) Inventors: Joseph Leo Vallatini, Plymouth, MA (US); Eleanore Vallatini, Plymouth, MA (US)

( * ) Notice: Subject to any disclaimer, the term of this patent is extended or adjusted under 35 U.S.C. 154(b) by 0 days.

(21) Appl. No.: 17/450,720

(22) Filed: Oct. 13, 2021

(65) Prior Publication Data

US 2022/0110460 A1 Apr. 14, 2022

Related U.S. Application Data

(60) Provisional application No. 63/091,045, filed on Oct. 13, 2020.

(51) Int. Cl.
*A47G 1/06* (2006.01)

(52) U.S. Cl.
CPC ..... *A47G 1/065* (2013.01)

(58) Field of Classification Search
CPC ..... A47G 1/065; A47G 1/08; A47G 1/166
See application file for complete search history.

(56) References Cited

U.S. PATENT DOCUMENTS

| | | | | |
|---|---|---|---|---|
| 3,129,524 | A | 4/1964 | Hayslett | |
| 5,735,068 | A | 4/1998 | Houssian | |
| 9,351,593 | B1 * | 5/2016 | Little | A47G 1/02 |
| 2008/0276420 | A1 | 11/2008 | Johnson | |
| 2009/0049727 | A1 * | 2/2009 | Vincent | A47G 1/065 40/729 |
| 2009/0077851 | A1 * | 3/2009 | Blackshear-Smith | A47F 5/0087 40/747 |
| 2010/0024271 | A1 * | 2/2010 | Seidler | G11B 33/0483 40/711 |

FOREIGN PATENT DOCUMENTS

| | | | |
|---|---|---|---|
| CN | 202234295 | U | 5/2012 |
| CN | 202477120 | U | 10/2012 |
| DE | 19540889 | A1 | 5/1997 |
| FR | 2759267 | A3 | 8/1998 |
| GB | 2388774 | A | 11/2003 |

OTHER PUBLICATIONS

"Discount Room Divider Screens," https://discountroomdividerscreens.wordpress.eom/2013/11/15/5-x-7-picture-frame-room-divider-5ft-63-double-sided-photo-display-folding-screen-3-4-5-or-6-panels-4-colors/ (Year: 2013).*

"The Creative Imperative," http://thecreativeimperative.blogspot.com/2012/05/shopping-at-su-casa-guess-what-i-chose.html (Year: 2012).*

Corner Photo Frame, Ravi Press Photo, 2020.

* cited by examiner

*Primary Examiner* — Gary C Hoge
(74) *Attorney, Agent, or Firm* — Law Office of Scott C Harris, Inc

(57) ABSTRACT

A hinged collage frame has hinge areas at the top and bottom, formed by curved edges. The hinging allows the collage frame to hinged to either an inner wall surface corner and outer wall corner or to stand up straight, or to lie flat. The hinging is carried out by having edges which are curved, where one curved convex edge moves relative to another curved concave edge.

12 Claims, 3 Drawing Sheets

COLLAGE FRAME WITH VARIABLE MOUNT AND CONFIGURATION

This application claims priority from provisional application No. 63/091,045, filed Oct. 13, 2020, the entire contents of which are herewith incorporated by reference.

BACKGROUND

Collage frames are used to display multiple different display items, such as photographs.

A typical kind of collage frame which exists in the current marketplace comprises a number of different frames placed together that sit flat on a wall. However, this allows very limited kinds of mounting and configuration.

SUMMARY OF THE INVENTION

The inventor recognized that there are a number of drawbacks with the current kinds of frames.

The present invention describes a multiple part, e.g., 2 part, collage frame which has the two parts hinged in a way that full body folding over 180 degrees, and allows hanging it on an outside corner wall, an inside corner wall, or flat on a wall or standing up on its own.

An embodiment describes a frame that is symmetric around its centerline, hinged at that centerline at top and bottom and having mitred edges between the top and bottom. The frame includes a number of different size frames. In an embodiment, each row of frames has different sized frames.

BRIEF DESCRIPTION OF THE DRAWINGS

In the Drawings.

The figures show the different aspects of the invention, and specifically.

DETAILED DESCRIPTION

The present application describes a hinged collage frame which can be configured and mounted in multiple different configurations.

In an embodiment, a plurality of different frame pieces are attached together. The frame pieces can be standard size or custom size. A first line of frames 110 forms a first side, and a second line of frames 120 forms a second side. Each of the lines 110, 120 of frames has an edge along the side that meets with the other line of frames, to allow for a hinged connection along that meeting side, as described herein.

Each line of frames is formed of multiple frames, arranged in a line. Each of the multiple frames has an edge defining the perimeter of an inner area that forms a location for a display item such as a photo or picture. The area has a transparent covering over the area. Multiple frames in the line are of multiple different sizes, and no two adjacent frames in the line are of the same size.

The first line of frames 110 is hingedly attached to the second line of frames 120 which is arranged in the same way.

In the embodiment, there are two separate and separated hinge portions 131 at the bottom of the frame, and 132 at the top of the frame. The hinges are only at the top and bottom, rather than being all the way along the opening between the two frames. The hinges are of a type that allows the frame to fold in either direction with either the corner coining towards the front, or the corner facing away from the front. The hinge portions allow the two lines of the frame to pivot relative to one another by 180°, allowing varying a shape and orientation of the frame as constrained by the user's needs.

The hinge is formed and configured as described herein, for hinging the first frame side and second frame side between a first hinged connection which has the first frame side and the flat second frame side laying flat against one another in a first direction with front surfaces of the first and second frame sides touching one another, The second hinged connection has the first frame side and the second flat frame side lay flat against one another in a second direction with rear surfaces of the first and second frame sides touching one another.

Thus, this hinged connection can allow any configuration of hinging between the first and second frame sides.

Different forms of the collage frame form different embodiments of the invention. There are different ways of using the frame.

Figure 1:
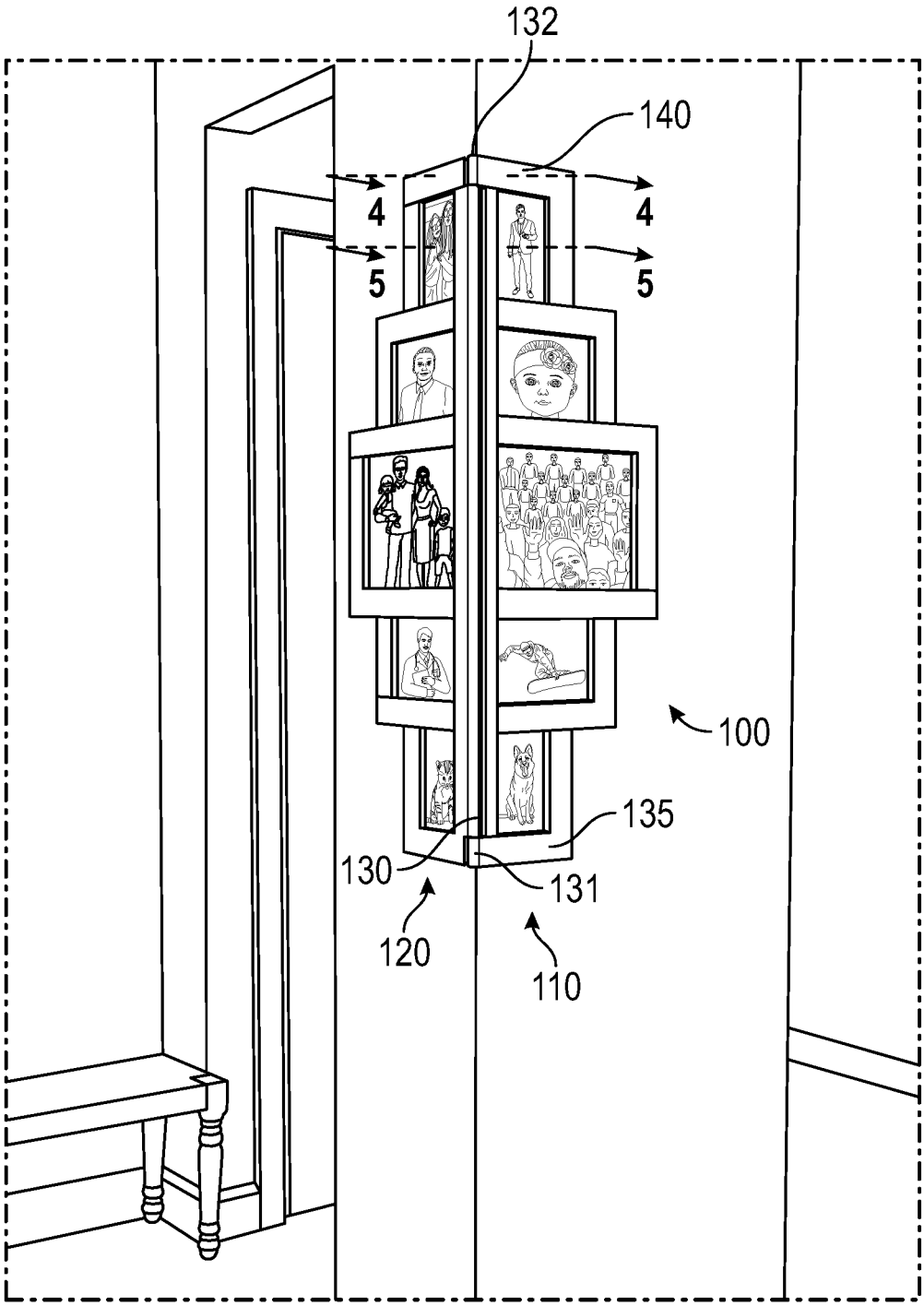
FIG. 1 shows an embodiment located along an outer edge of an edged wall.

FIG. 1 shows a first frame system 100, with the first frame side 110 and the second frame side 120. There is also a hinge 130 line between the first frame side and the second frame side. The hinge line 130 is formed from a first hinge 131 at the bottom of the frame, the hinge line 130, which is formed from a pair of mitered sections on the inside edges of the frame, and finally a second hinge part 132 at the top of the frame.

Each of the first hinging part 131 and the second hinging part 132 use hinges that are the thickness of the wall of a corresponding frame. That is, the hinging part 131 is the thickness of 135 which is the bottommost frame. The edge 140 of the topmost frame defines the thickness of the first the top hinge part 132. The hinge side along the length between the hinges 131, 132 is routed to form shapes that can move relative to one another, e.g. one side being a convex shape and the other side being a concave shape.

FIG. 1 shows the frame 100 being hinged to an outside edge of a wall. In the frame 100. In FIG. 1, each of the frames in each line is different in size the next frame in the line.

Figure 2:
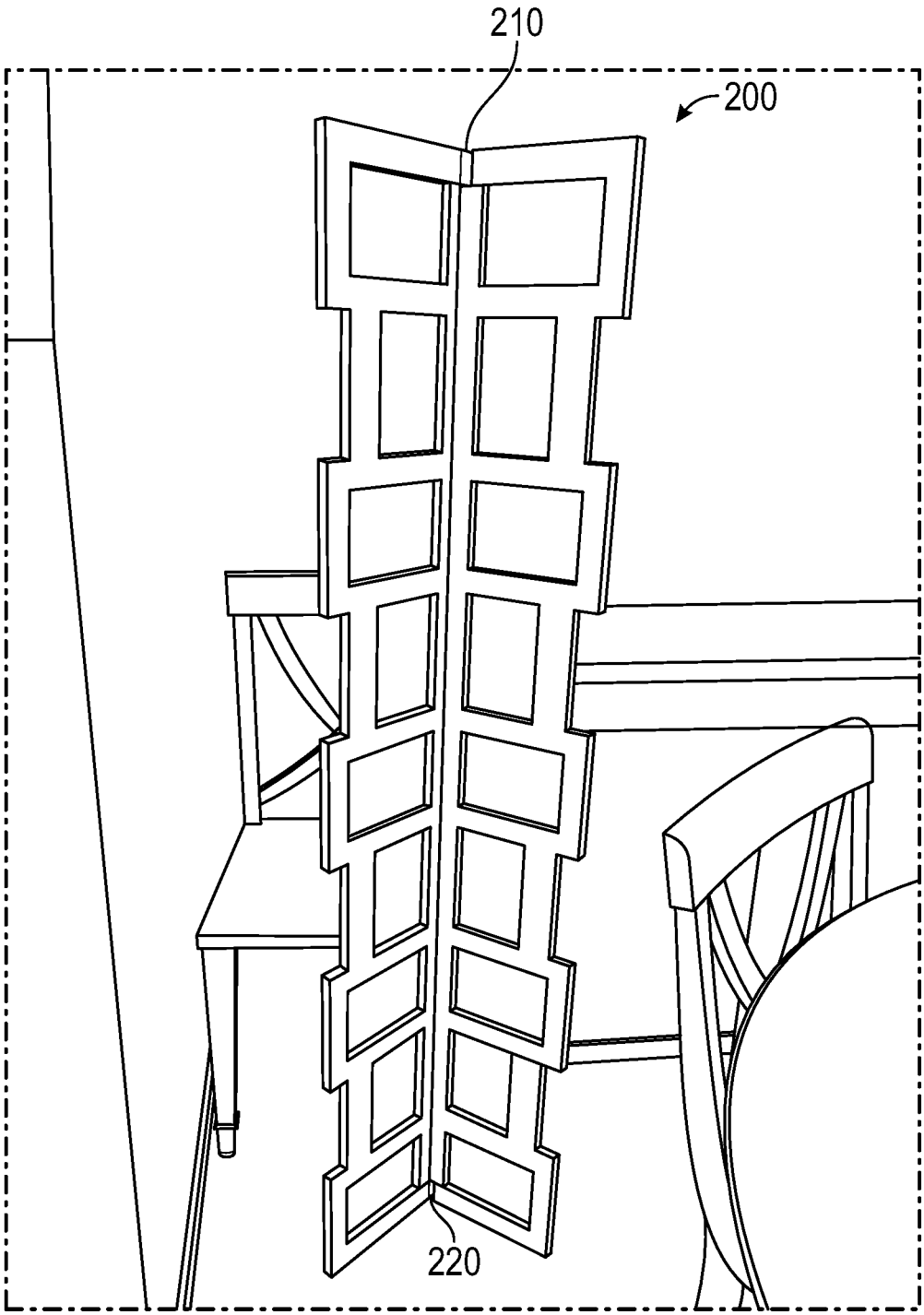
FIG. 2 shows an embodiment configured to fold along an inner edge.

FIG. 2 shows another frame 200, configured to free stand in its upward position. This frame is similarly hinged on the top hinge 210 and a bottom hinge 220. By configuring the hinge in this way to an angle, the frame can be configured as freestanding.

In more general terms, however, the hinge can adjust from an inside corner of 90° to an outside corner of 270° as well as any angle in between. This allows the hinge to fit on any inside corner and any outside corner but also allows the hinge to sit flat on a wall, or to stand on its own as shown in FIG. 2.

Figure 3:
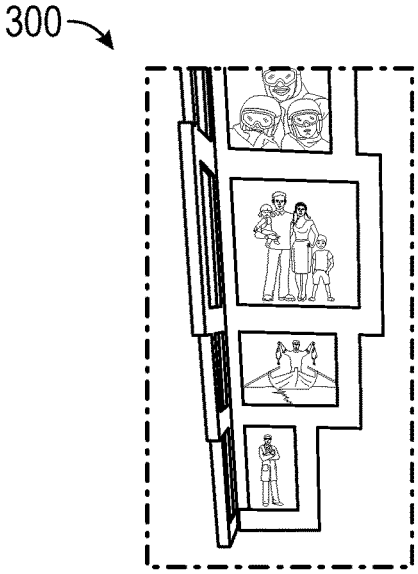
FIG. 3 shows an embodiment where the frame is located on an inner edge of an edged wall.

FIG. 3 illustrates a frame with the hinge 300 configured to sit on an inside corner.

The center hinge line, and top and bottom hinges, form the center axis of the device. Standard size frames are located between the first side 110 and the second side 1200. The standard size frames typically include 3×5, 4×6, 5×7, 8×10, and 16×20. In addition, other custom sizes can be used and attached to the centerpiece to create the different appearance.

In operation, the frame is formed by starting with 1×2×8" wood blanks. Each of the blanks are cut to a predetermined length which will form the overall height of the frame. The cut pieces are then placed on two sides to achieve a uniform width and depth. From there, all the pieces are drilled to accommodate quarter-inch wooden dowels using a custom drill to control the locations of the holes. Assembly uses the dowels and wood glue. In an embodiment, quarter-inch wooden dowels to build the left side and the right side. Once assembled, the hinge side along the length is routed using a ⅜ radius to allow clearance for the frame pivoting. The hinge is then created using a 3/16×2.5 dowels on the two ends 131, 132. Button plugs create a finish for the dowel holes.

The operation creates a hinge area at the top (and bottom) and creates mitered terminable areas at the areas between the hinge areas. These different areas each have curved outer surfaces, which curved in opposite directions from one another.

Figure 4:
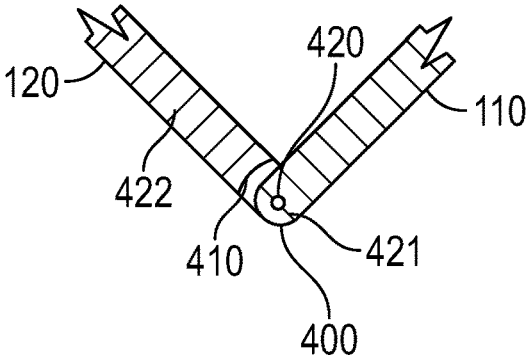
FIG. 4 illustrates a cross-section of the frame along the hinge.

A cross-section through a hinged area at the top, along the line 4-4 is shown in FIG. 4. The first frame side 110, shown as end area 421 ends in convex surface 400. The second frame side 120 ends in a concave curve surface shown as 410 formed on end area 422. The convex side 400 connects to the area below the hinge area, using a hinge pin 420 that connects through a center of the convex surface of the end area 421. The first frame side 110 hinges relative to the 2nd frame side on this hinge pin 420.

Figure 5:
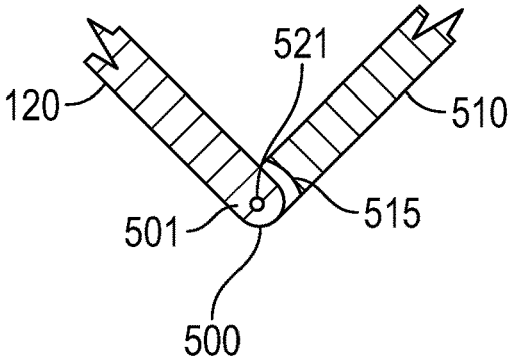
FIG. 5 illustrates a cross-section of the frame along a non-hinged area.

FIG. 5 shows a cross-section along the line 5-5 in FIG. 1, that is the area of the frame assembly just below the hinge area. In this area below the hinge, the convex and concave nature of the first and second frame sides are reversed. The first frame side 110 has an end area 515 which ends in a concave outer shape 510. The second frame side 120 has an end area 502 that ends in a convex outer shape 500. The pin 420 extends through the concave portion 421 in the hinge, which is on the side 110, into the concave portion 502 on the edge 500 on the edge, which is on the side 120. The end of the pin 521 is shown extending into that concave portion. It should be understood however, that the pin may extend only a small distance into the portion 502, for example by an amount equal to the distance of the hinge.

In this way, the hinge is formed of a concave and convex portion which move relative to one another, connected to a concave and convex portion on the below area which again move relative to one another. The portions shown in FIG. 5 move freely relative to one another, while the portions shown in FIG. 4 form the hinging operation that allows the movement relative to the pin. However, the areas between the top and bottom hinges are curved relative to one another so that they can move relative to one another, but are not actually attached, the attachment only occurs at the area of the pins.

Once assembled, the pieces are sanded, prepped and painted, glass and the backing is installed.

Once assembled, the standard size frames are connected to the hinge and allow the user the versatility of painting their photos or artwork or display.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A hinged frame system, comprising:

a first frame side, formed of multiple frames, arranged in a first line, each of the multiple frames having an edge defining the perimeter of an area, and having a transparent covering over the area, and where the multiple frames in the first line are of multiple different sizes, and no two adjacent frames in the line are of the same size, the first frame side having a first side formed of a first edge;

a second frame side, having a second edge, abutting against said first edge of said first frame side, said second frame side formed of multiple frames, arranged in a second line, each of the multiple frames having an edge defining the perimeter of an area, and having a transparent covering over the area, and where the multiple frames in the second line are of multiple different sizes, and no two adjacent frames in the second line are of the same size; and a hinge, connecting between said first frame side and said second frame side, said hinge configured for hinging the first frame side and second frame side between a first hinged position and a second hinged position, and all positions between the first hinged position and the second hinged position, where the first hinged position has the first frame side and the second frame side forming an inside corner of 90°, where the second hinged position has the first frame side and the second frame side from an outside corner of 270°, wherein the first edge and the second edge each have a curved outer surface, to allow hinged rotation relative to one another.

2. The system as in claim 1, wherein the hinge includes a first hinging part located at a top of the first and second frame sides and a second hinging part at a bottom of the first and second frame sides, and where there is no hinging parts at an area between the top and bottom.

3. The system as in claim 2, wherein the first hinging part has the thickness of the first and second frame sides.

4. The system as in claim 2, wherein the first and second hinging parts comprise a convex curved part on an end of one of the frame sides, and a concave curved part on an end of the other of the frame sides.

5. The system as in claim 4, wherein the frame sides have an area below the hinging parts, which comprises a concave curved part on the end of said one of the frame sides and a convex curved part on the end of said other of the frame sides.

6. The system as in claim 5, further comprising a hinge pin, extending through the convex mitered part on the end of the one of the frame sides into the convex mitered part on the other of the end of the frame sides in the area below the hinging parts.

7. The system as in claim 1, where adjacent frames on the first frame side and on the second frame side have a same overall size to one another.

8. The system as in claim 1, wherein the first frame side and second frame side are hinged to a position covering an outer surface corner.

9. The system as in claim 1, wherein the first frame side and the second frame side are hinged to a position covering an inner surface corner.

10. The system as in claim 1, wherein the first frame side and the second frame side have flat bottoms, and are hinged to a position which allows the frame to stand up straight.

11. The system as in claim 1, wherein the first frame side and the second frame side are hinged to a position allowing flat mounting on a flat surface.

12. A hinged frame system, comprising:

a first frame side, formed of multiple frames, arranged in a first line, each of the multiple frames having an edge defining the perimeter of an area, and having a transparent covering over the area, and where the multiple frames in the first line are of multiple different sizes, and no two adjacent frames in the line are of the same size, the first frame side having a first side formed of a first edge;

a second frame side, having a second edge, abutting against said first edge of said first frame side, said second frame side formed of multiple frames, arranged in a second line, each of the multiple frames having an edge defining the perimeter of an area, and having a transparent covering over the area, and where the multiple frames in the second line are of multiple different sizes, and no two adjacent frames in the second line are of the same size; and a hinge, connecting between said first frame side and said second frame side, said hinge configured for hinging the first frame side and second frame side between a first hinged position and a second hinged position, and all positions between the first hinged position and the second hinged position, where the first hinged position has the first frame side and the second frame side forming an inside corner of 90°, where the second hinged position has the first frame side and the second frame side from an outside corner of 270°, wherein the hinge includes a first area at the top of the first frame side and a first area at the top of the second frame side, and a second area at the bottom of the first frame side and a second area at the bottom of the second frame side, and wherein areas between the top of the first and second frame sides and the bottom of the first and second frame side are not hinged relative to one another, but are each curved to allow movement hinging movement relative to one another.

* * * * *